US005655221A

United States Patent [19]

Worischeck

[11] Patent Number: 5,655,221

[45] Date of Patent: Aug. 12, 1997

[54] ARTICULATED UPPER ARM BLOCKER PAD FOR HOCKEY GOALKEEPERS

[76] Inventor: Harry D. Worischeck, 9992 Riverdale, Redford Township, Wayne County, Mich. 48239

[21] Appl. No.: 694,504

[22] Filed: Aug. 7, 1996

[51] Int. Cl.[6] ..... A41D 13/08

[52] U.S. Cl. ..... 2/16

[58] Field of Search ..... 2/2, 16, 44, 45, 2/459, 461, 462, 463

[56] References Cited

U.S. PATENT DOCUMENTS 5,007,108 4/1991 Laberge et al. ..... 2/2

5,204,993 4/1993 Siemens ..... 2/2

*Primary Examiner*—Michael A. Neas

*Attorney, Agent, or Firm*—Peter D. Keefe

[57] ABSTRACT

An upper arm blocker pad for the lead arm of a goalkeeper which provides impact protection from high velocity hockey pucks in the sense that the conventional back pad provides such protection for the hand and forearm, and further provides deflection control of impacting pucks similarly to that achievable with a conventional back pad. The upper arm blocker pad is generally composed of an upper arm pad member for protectively covering the upper arm, an elbow pad member for protectively covering the elbow, a pivot member for pivotally connecting the upper arm pad member to the elbow pad member, and a connection member for connecting the upper arm pad member and the elbow pad member to the lead arm of the goalkeeper in a selectively releasable manner.

18 Claims, 3 Drawing Sheets

ARTICULATED UPPER ARM BLOCKER PAD FOR HOCKEY GOALKEEPERS

BACKGROUND OF THE INVENTION

1. Field of the Invention

The present invention relates to the game of hockey, and more particularly to the equipment worn by a goalkeeper in the game of hockey. Still more particularly, the present invention relates to an upper arm blocker pad for aiding protection of the lead arm of a goalkeeper vis-a-vis flying hockey pucks.

2. Description of the Prior Art

The game of hockey includes a goal having a net at opposite ends of a rink having an ice surface, wherein it is the object of the game for opposing teams to cause a hockey puck to be deposited into the net of the goal of the opponent team. In order to prevent the hockey puck from being easily deposited in their goal, each team has a goalkeeper situated at the opening of their goal in order to deflect an incoming hockey puck away from the goal. In this regard, the players of the opposing teams are equipped with player's sticks which are used to propel the hockey puck, and the goalkeepers are equipped with a goalkeeper's stick which is used to deflect the hockey puck.

Due to the fact that players target the hockey puck for flight toward the opposing team's goal, the goalkeepers are subjected to exposure to dangerously high velocity hockey puck trajectories. Accordingly, the goalkeepers are equipped with protective coverings which aid in preventing injury in the event a hockey puck should strike the goalkeeper.

Conventionally, a goalkeeper has the following protective coverings:

- a helmet with an integral face guard;
- a throat protector;
- an arm pad which originates at the chest, extends across the collar bone and extends the length of both arms, wherein articulation is provided at the elbows;
- a body pad;
- a back pad and stick glove which protects the forearm and hand of the lead arm of the goalkeeper;
- a catch glove on the hand of the trailing arm; and
- full-length leg pads.

The back pad includes a stick glove into which the goalkeepers hand is inserted. The back pad is generally of rectangular shape, covering the entire hand and at least a majority of the forearm. The back pad has a thick leather skin at the facing side thereof and has thereunder the following layers in usually the following order: a first resilient foam layer; a plastic spine layer; a rigid, lightweight cellular foam layer; a second resilient foam layer and a canvass or leather skin at the rear side, wherein the skin forms a covering for the other layers. The arm pad is similarly constructed to that of the back pad in terms of materials and layers, but the layers are thinner.

While the protective coverings for goalkeepers are useful and serve their purpose well, there remains needed protective covering for the upper arm of the lead arm of goalkeepers, which location is very vulnerable to a striking impact from a high velocity hockey puck, in spite of the fact that a conventional arm pad is provided.

SUMMARY OF THE INVENTION

The present invention is an upper arm blocker pad for the lead arm of a goalkeeper which provides impact protection from high velocity hockey pucks in the sense that the conventional back pad provides such protection for the hand and forearm, and further provides deflection control of impacting pucks similarly to that achievable with a conventional back pad.

The upper arm blocker pad according to the present invention is generally composed of an upper arm pad member for protectively covering the upper arm, an elbow pad member for protectively covering the elbow, a pivot member for pivotally connecting the upper arm pad member to the elbow pad member, and a connection member for connecting the upper arm pad member and the elbow pad member to the lead arm of the goalkeeper in a selectively releasable manner.

Preferably, both the upper arm pad member and the elbow pad member have a structure similar to that of a conventional back pad, that is, a thick leather skin at the facing and rear sides thereof, and therein side the following layers are provided: a first resilient foam layer adjacent the skin at the facing side; a plastic spine layer; a rigid, lightweight cellular foam layer; and a second resilient foam layer adjacent the skin at the rear side.

Preferably, the connection member is in the form of straps having a two component releasable fastener, such as for example VELCRO (trademark of Velcro, USA).

Accordingly, it is an object of the present invention to provide an upper arm blocker pad for protecting the lead arm of a goalkeeper of the game of hockey from injury or unpleasant sensation when a puck impacts generally thereat.

It is an additional object of the present invention to provide an upper arm blocker pad having a facing side which is substantially flat, whereby the facing side may be selectively oriented with respect to the trajectory of impacting pucks to thereby selectively deflect the puck in a desired direction.

These, and additional objects, advantages, features and benefits of the present invention will become apparent from the following specification.

DETAILED DESCRIPTION OF THE PREFERRED EMBODIMENT

Figure 2:
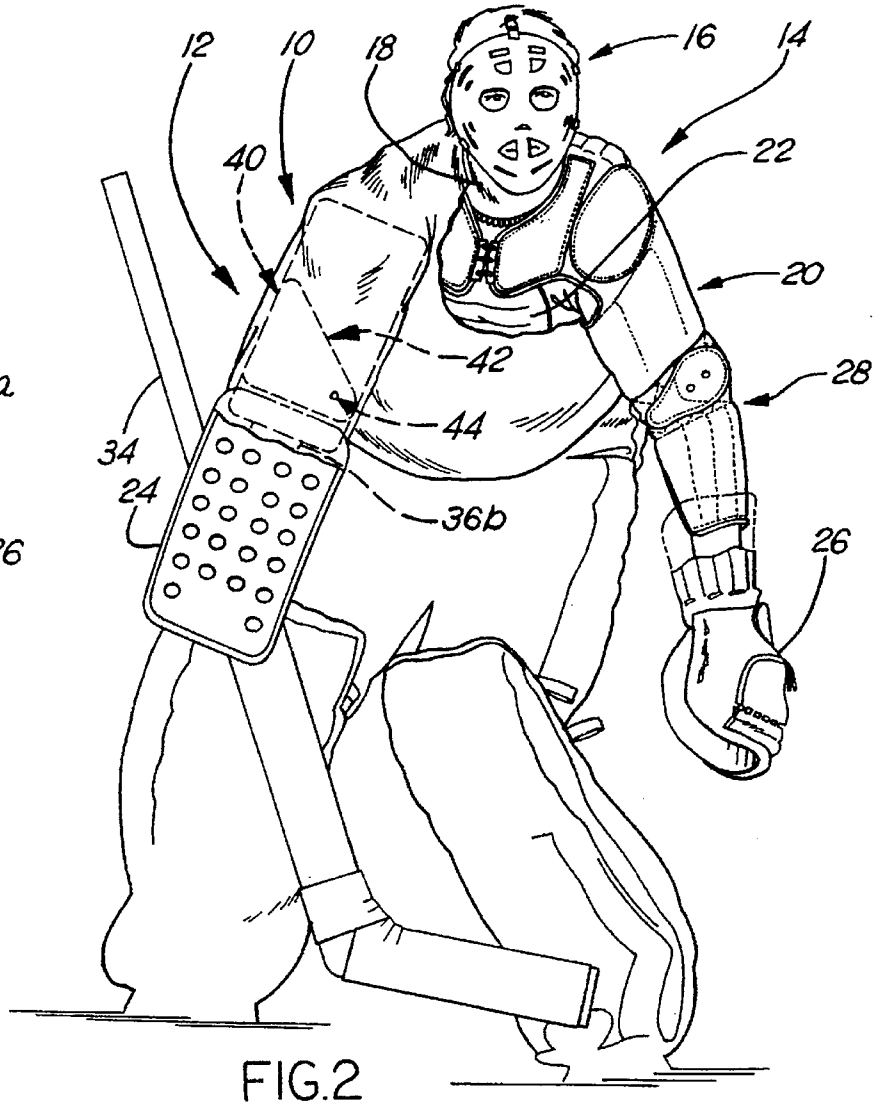
FIGS. 1 and 2 are front plan views of the upper arm blocker pad according to the present invention, shown in operation by being worn by a goalkeeper.
Figure 1:
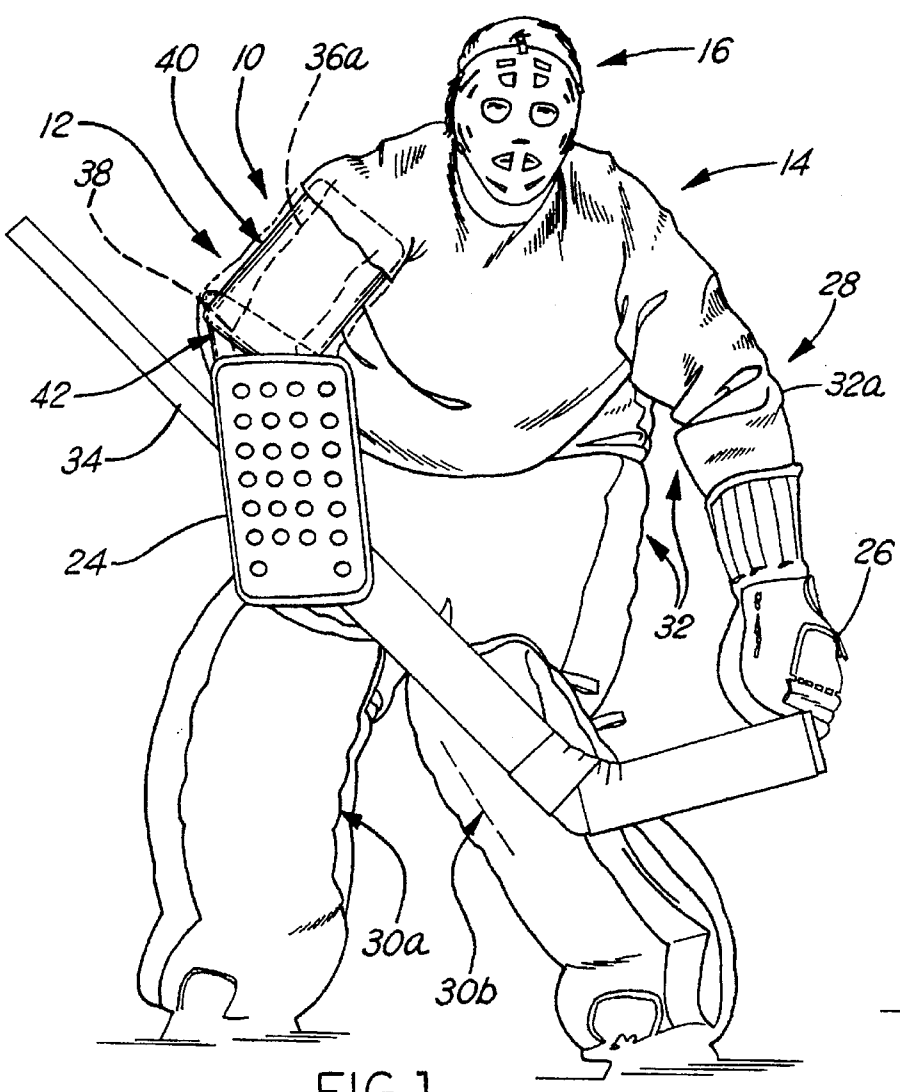

Referring now to the Drawing, FIGS. 1 and 2 the upper arm blocker pad 10 according to the present invention is shown in operation being worn on the lead arm 12 of a goalkeeper 14. The goalkeeper 14 is also wearing conventional protective coverings which include: a helmet with an integral face guard 16; a throat protector 18; an arm pad 20 for covering each arm and collar bone area; a body pad 22; a back pad 24 which protects the forearm and hand of the lead arm of the goalkeeper, and which includes a stick glove (not visible); a catch glove 26 on the hand of the trailing arm 28 of the goalkeeper; and full-length leg pads 30*a*, 30*b*. The goalkeeper 14 is also seen wearing a uniform 32, including a jersey 32*a*. The goalkeeper 14 grasps a goalkeeper's stick 34 using the stick glove of the back pad 24.

The upper arm blocker pad 10 provides complete protection for the upper arm 36*a* and elbow 38 of the lead arm 12 of the goalkeeper 14. In this regard, the upper arm blocker pad 10 includes an upper arm pad member 40, an elbow pad member 42 and a pivot member 44 which pivotally connects the upper arm pad member to the elbow pad member whereby the upper arm blocker pad is provided with articulation at the elbow 38.

In operation, the goalkeeper 14 puts on the conventional protective coverings and the upper arm blocker pad 10, wherein the arm pad 20 is put on, then the upper arm blocker pad, and finally the back pad 24. When defending a goal, the goalkeeper uses the flat facing sides of both the back pad and the upper arm blocker pad 10 to selectively deflect impacting pucks in a desired direction away from the goal.

Referring now additionally to remaining FIGS. 3 through 9, the structure and function of the upper arm blocker pad 10 will be detailed with greater specificity.

Figure 3:
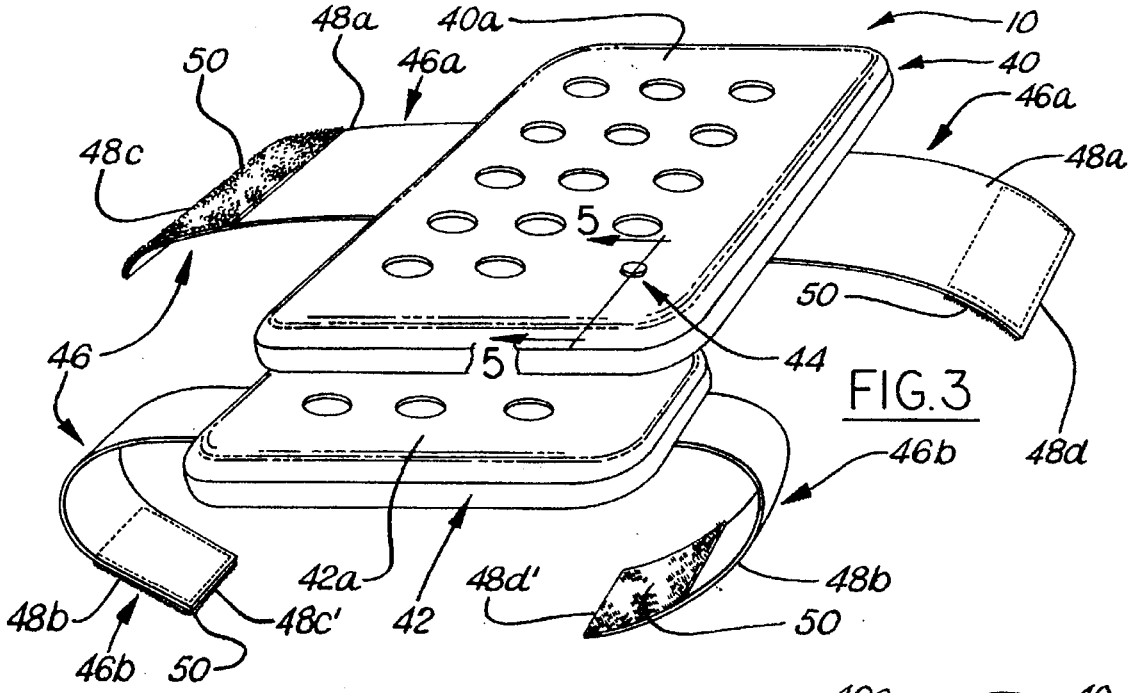
FIG. 3 is a perspective view of the upper arm blocker pad according to the present invention.
Figure 4:
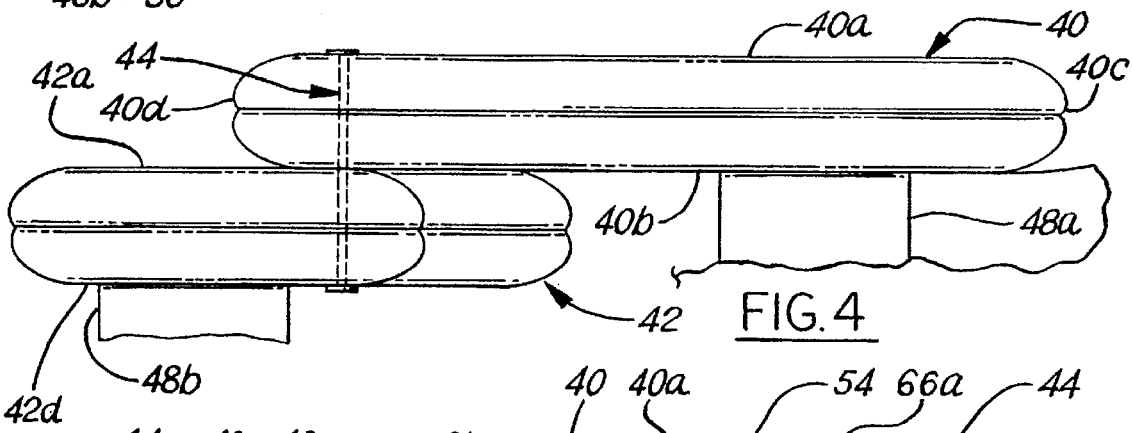
FIG. 4 is a partly broken away side view of the upper arm blocker pad according to the present invention.

As shown by FIGS. 3 and 4, the upper arm pad member 40 is preferably of a generally rectangular shape, wherein the facing side 40*a* is substantially flat between a top end 40*c* and a bottom end 40*d*. The upper arm pad member 40 is dimensioned to protectively cover the upper arm of the lead arm of a goalkeeper to thereby spare the upper arm from hurt due to impacting pucks. Further, the flatness of the facing side 40*a* provides a surface for deflecting in coming pucks in a skillfully predictable manner which the goalkeeper can use to advantage to cause the puck to rebound away in a direction safest for defending the goal depending on the movement and placement of the players on the rink. Puck deflection is used to advantage conventionally by goalkeepers with respect to the back pad (see FIGS. 1 and 2); now, the goalkeeper has the additional surface area of the facing side 40*a* of the upper arm pad member 40 for this important and potentially game winning technique.

Figure 6A:
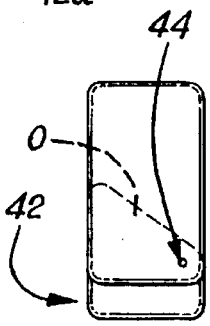
FIGS. 6A and 6B are plan views of the upper arm blocker pad according to the present invention, seen at two different articulation positions.
Figure 6B:
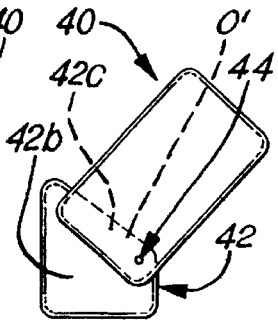

The elbow pad member 42 also has a substantially flat facing side 42*a* which not only protects the elbow area of the goalkeepers arm, but is also usable to skillfully deflect pucks. As depicted at FIGS. 6A and 6B, it is preferred for the elbow pad member 42 to have a rectangular lower portion 42*b* and and triangular upper portion 42*c*. Such a shape ensures that when the elbow pad member 42 pivots relative to the upper arm pad member 40 (see FIG. 6B), there is always overlap O, O' thereof which serves to protect the arm of the goalkeeper, as will be further elaborated hereinbelow.

It is preferred for the external sides of both the upper arm pad member 40 and the elbow pad member 42 to be covered by a skin of leather, and preferably have a look similar to, or at least harmonious with, a conventional back pad (see FIGS. 1 and 2). However, it should be noted that, as shown by FIGS. 1 and 2, it is preferred, but certainly not required, for the upper arm blocker pad 10 to be worn under the sleeve of the goalkeeper's jersey 32*a*.

The upper arm blocker pad 10 includes the aforementioned pivot member 44 which allows for articulation relatively between the upper arm pad member 40 and the elbow pad member 42. The location of the pivot member 44 is such as to locate the pivot formed thereby so as to provide cooperative and functionally noninterfering articulation of the upper arm blocker pad 10 with bending by the goalkeeper's elbow 38.

The upper arm blocker pad 10 further includes a connection member 46 which has an upper arm pad connection member portion 46*a* and and an elbow pad connection member portion 46*b*. As mentioned hereinabove, the connection member 46 attaches, in a selectively releasable manner, the upper arm blocker pad 10 to the lead arm of the goalkeeper 14. The preferred form of the connection member 46 is an open ended first connector strap 48*a* connected with the upper arm pad member 40 and an open ended second connector strap 48*b* connected with the elbow pad member 42. In this regard, each of the first and second connector straps 48*a*, 48*b* include a two component releasable fastener 50 to provide selective connection of the open ends 48*c*, 48*d*, 48*c*', 48*d*' so that the first and second connector straps tightly engird the upper arm and forearm of the goalkeeper's lead arm, respectively. A preferred two component releasable fastener 50 is a flexible hook and loop fastener, such as for example a product known as "VELCRO" (trademark of Velcro, USA). In the preferred construction of the first and second connector straps 48*a*, 48*b*, the first and second connector straps are attached to the rear side 40*b*, 42*d*, of the upper arm pad member 40 and the elbow pad member 42, respectively. The attachment may be by any conventional mechanism, such as sewing 52. The first and second connector straps 48*a*, 48*b* are composed of an easily flexible, yet strong material which may or may not be stretchable, wherein a stretchable material is preferred, such as a fabric covered elastic.

Figure 5:
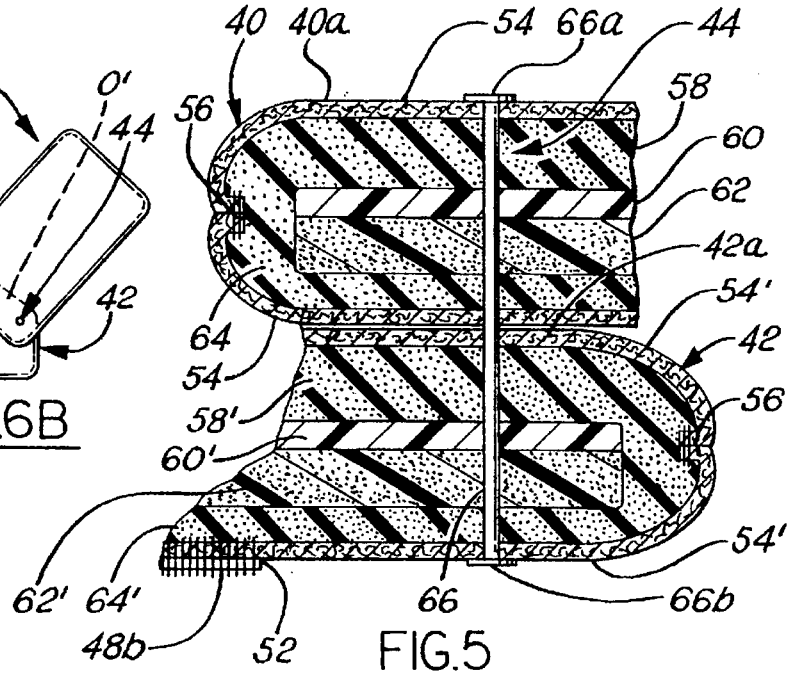
FIG. 5 is a partly sectional, partly broken away side view of the upper arm blocker pad according to the present invention, seen along line 5—5 in FIG. 3.

FIG. 5 depicts a preferred construction of the upper arm blocker pad 10 by way of preferred example only. It is to be understood that those skilled in the art may elect to modify the following exemplary construction, and that any such mortifications are considered within the spirit of the present invention as it is broadly construed by the claims appended hereto.

As shown by FIG. 5, each of the upper arm pad member 40 and the elbow pad member 42 have similar constructions, as follows. An exterior skin 54, 54', preferably of leather, covers each of the facing side and the rear side and each is respectively coveringly formed together by sewing 56. Within the skin of each of the upper arm pad member 40 and the elbow pad member 42 are the following layers: a first resilient foam layer 58, 58', such as for example foam rubber; a stiff spine layer 60, 60', preferably composed of plastic; a rigid, lightweight cellular foam layer 62, 62', such as for example a cellular polystyrene, an example of which being a ubiquitous trademark product known as STYROFOAM; and a second resilient foam layer 64, 64', such as for example foam rubber. The first and second resilient foam layers may be formed, respectively, as a single piece (as shown), and it is preferred for adjoining layers to be mutually attached, such as by an adhesive. The order of the layers may be altered from that shown in FIG. 5. For example, the rigid, lightweight cellular foam layer may be on the facing side of the spine layer (opposite to that shown in FIG. 5), and, and while this layering order is the same as the usual layering order used for conventional back pads, it is not preferred so that the rigid, lightweight cellular foam faces the arm of the goalkeeper whereby it will not be dented or otherwise damaged by puck impacts and will serve to soften impacts against the arm of the goalkeeper.

By way of exemplification only, the following thicknesses are given as merely preferred (not required) thicknesses: the leather of the skin is preferred to be relatively thick for providing durability against abrasion associated with the wear and tear of use during a hockey game, similar to the leather thickness of a conventional back pad. The first resilient foam rubber layer is about one-eighth of an inch thick; the plastic of the spine layer is about one-eighth to one-sixteenth of an inch thick; the rigid, lightweight cellular foam layer is about one-half of an inch thick; and the second resilient foam layer is about one-half of an inch thick.

As further shown by FIG. 5, the pivot member 44 is preferred to be a pin 66 which extends through each of the upper arm pad member 40 and the elbow pad member 42, having a head 66*a* at one end (preferably at the facing side 40*a*) and a rivet end 66*b* at the other end (preferably at the rear side 42*d*).

Figure 7:
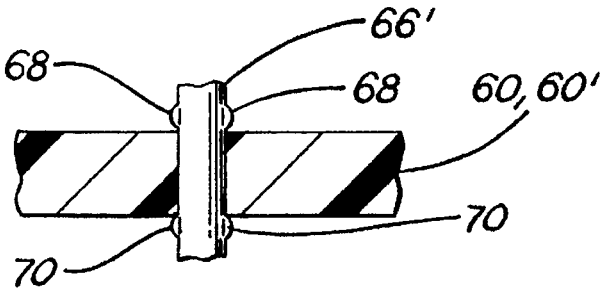
FIG. 7 is a partly sectional, detail side view of an alternative pivot member of the upper arm blocker pad according to the present invention.

FIG. 7 depicts a variation of the pivot member, wherein the pin 66' now is provided with opposing nibs 68, 70 (which may be annular or discrete) for abutting each side of the spine layers 62, 62'. The nibs 68, 70 provide fixed axial location of the upper arm pad member 40 and the elbow pad member 42 relative to the pin 66', for aiding trouble free articulation, without binding or excessive wear of the skin 54, 54'.

Figure 9:
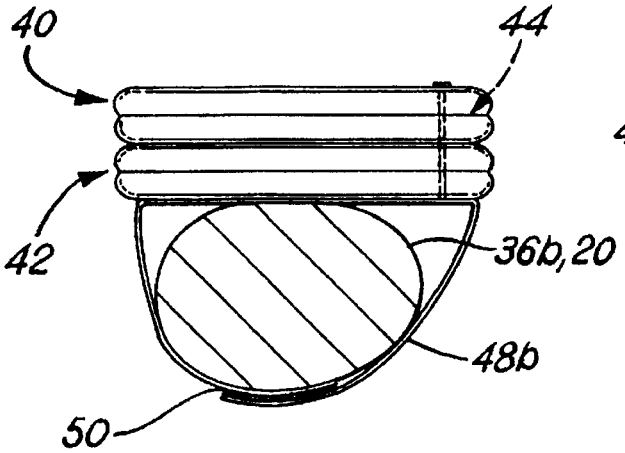
FIG. 9 is a partly sectional end view of the upper arm blocker pad according to the present invention and arm of the goalkeeper, seen along line 9—9 of FIG. 8.
Figure 8:
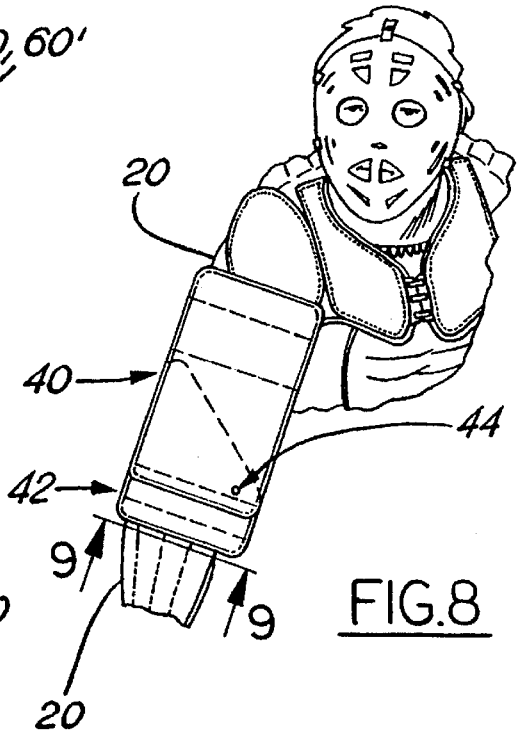
FIG. 8 is a broken-away detail perspective view of the upper arm blocker pad according to the present invention being worn by a goalkeeper over his arm pad.

Referring now to FIGS. 8 and 9 operation of the upper arm blocker pad 10 will be described.

The goalkeeper 14 puts on the conventional protective coverings and the upper arm blocker pad 10, wherein the arm pad 20 is put on, then the upper arm blocker pad 10, and finally the back pad 24. In this regard, the first connector strap 48*a* is tightly wrapped around the arm pad at the upper arm, and the second connector strap 48*b* is tightly wrapped around the arm pad at the forearm. In so doing, the position of the upper arm blocker pad is adjusted to ensure that the pivot member 44 provides articulation cooperatively with bending of the goalkeeper's elbow. Alternatively, the first and second connector straps may be wrapped around the upper arm and forearm, respectively, of the goalkeeper's arm (ie., not around the arm pad).

When defending a goal, the goalkeeper uses the flat facing sides of the conventional back pad and the upper arm blocker pad 10 to selectively deflect impacting pucks in a desired direction away from the goal, without concern for injury due to impact with the puck. The combination of the deflection control and the psychological freedom from worry of injury provided by the upper arm blocker pad 10 serve to improve goalkeeper performance.

It is to be noted that while hockey is considered to be the preferred game for which the present invention is used, other games involving game piece projectiles may also make use of the present invention, including for example lacrosse.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. An upper arm blocker pad for an arm of a hockey goalkeeper, comprising:

an upper arm pad member structured to cover an upper arm of an arm of a goalkeeper to thereby protect the upper arm from injury due to impact with a flying hockey puck, said upper arm pad member has a substantially flat facing side located between an upper end and a lower end thereof;

an elbow pad member structured to cover an elbow area of the arm of the goalkeeper to thereby protect the elbow area from injury due to impact with a flying hockey puck, said elbow pad member has a substantially flat facing side, said elbow pad member having a triangular shaped portion;

pivot means for pivotally connecting said upper arm pad member to said elbow pad member; and connection means for connecting said upper arm pad member to the upper arm, and for connecting the elbow pad member to a forearm of the arm of the goalkeeper;

wherein said pivot means is positioned relative to said triangular shaped portion such that as said elbow pad member is pivoted relative to said upper arm pad member, said lower end of said upper arm pad member and said elbow pad member continuously overlap each other.

2. The upper arm blocker pad of claim 1, wherein each of said upper arm pad member and said elbow pad member comprise:

a first resilient foam layer;

a stiff spine layer;

a stiff, lightweight cellular foam layer;

a second resilient foam layer; and a skin covering said first resilient foam layer, said spine layer, said rigid, lightweight cellular foam layer and said second resilient foam layer.

3. The upper arm blocker pad of claim 2, wherein each of said upper arm pad member and said elbow pad member further comprise:

said stiff spine layer adjoins said first resilient layer;

said rigid, lightweight cellular foam layer adjoins said spine layer; and said second resilient foam layer adjoins said rigid, lightweight cellular foam layer.

4. The upper arm blocker pad of claim 3, wherein said connection means comprises:

an upper arm connection member portion comprising:

at least one first connector strap connected with said upper arm pad member, said at least one first connector strap having open ends; and first releasable fastener means for selectively connecting together said open ends of said at least one first connector strap; and an elbow pad connection member comprising:

at least one second connector strap connected with said elbow pad member, said at least one second connector strap having open ends; and second releasable fastener means for selectively connecting together said open ends of said at least one second connector strap.

5. The upper arm blocker pad of claim 4, wherein said skin comprises leather, said spine layer comprises plastic, said first and second resilient foam layers comprise foam rubber, and said rigid, lightweight cellular foam layer comprises polystyrene; and wherein said at least one first and second connector straps are composed of elastic material.

6. An upper arm blocker pad for an arm of a hockey goalkeeper, comprising:

an upper arm pad member structured to cover an upper arm of an arm of a goalkeeper to thereby protect the upper arm from injury due to impact with a flying hockey puck, wherein said upper arm pad member has a substantially flat facing side located between an upper end and a lower end thereof;

an elbow pad member structured to cover an elbow area of the arm of the goalkeeper to thereby protect the elbow area from injury due to impact with a flying hockey puck;

pivot means for pivotally connecting said upper arm pad member to said elbow pad member; and connection means for connecting said upper arm pad member to the upper arm, and for connecting the elbow pad member to a forearm of the arm of the goalkeeper.

7. The upper arm blocker pad of claim 6, wherein said elbow pad member has a substantially flat facing side.

8. The upper arm blocker pad of claim 6, wherein said elbow pad member includes a triangular shaped portion, wherein further said pivot means is positioned relative to said triangular shaped portion such that as said elbow pad member is pivoted relative to said upper arm pad member, said lower end of said upper arm pad member and said elbow pad member continuously overlap each other.

9. The upper arm blocker pad of claim 8, wherein each of said upper arm pad member and said elbow pad member comprise:

a first resilient foam layer;

a stiff spine layer;

a stiff, lightweight cellular foam layer;

a second resilient foam layer; and a skin covering said first resilient foam layer, said spine layer, said rigid, lightweight cellular foam layer and said second resilient foam layer.

10. The upper arm blocker pad of claim 9, wherein each of said upper arm pad member and said elbow pad member further comprise:

said stiff spine layer adjoins said first resilient layer;

said rigid, lightweight cellular foam layer adjoins said spine layer; and said second resilient foam layer adjoins said rigid, lightweight cellular foam layer.

11. The upper arm blocker pad of claim 10, wherein said skin comprises leather, said spine layer comprises plastic, said first and second resilient foam layers comprise foam rubber, and said rigid, lightweight cellular foam layer comprises polystyrene.

12. The upper arm blocker pad of claim 6, wherein said connection means comprises:

an upper arm connection member portion comprising:

at least one first connector strap connected with said upper arm pad member, said at least one first connector strap having open ends; and first releasable fastener means for selectively connecting together said open ends of said at least one first connector strap; and an elbow pad connection member comprising:

at least one second connector strap connected with said elbow pad member, said at least one second connector strap having open ends; and second releasable fastener means for selectively connecting together said open ends of said at least one second connector strap.

13. The upper arm blocker pad of claim 12, wherein said at least one first and second connector straps are composed of elastic material.

14. The upper arm blocker pad of claim 12, wherein said first and second releasable fastener means comprises a flexible hook and loop fastener.

15. The upper arm blocker pad of claim 12, wherein said elbow pad member includes a triangular shaped portion, wherein further said pivot means is positioned relative to said triangular shaped portion such that as said elbow pad member is pivoted relative to said upper arm pad member, said lower end of said upper arm pad member and said elbow pad member continuously overlap each other.

16. The upper arm blocker pad of claim 15, wherein each of said upper arm pad member and said elbow pad member comprise:

a first resilient foam layer;

a stiff spine layer;

a stiff, lightweight cellular foam layer;

a second resilient foam layer; and a skin covering said first resilient foam layer, said spine layer, said rigid, lightweight cellular foam layer and said second resilient foam layer.

17. The upper arm blocker pad of claim 16, wherein said at least one first and second connector straps are composed of elastic material.

18. The upper arm blocker pad of claim 17, wherein said elbow pad member has a substantially flat facing side.

* * * * *